United States Patent [19]

Williams et al.

[11] Patent Number: 4,494,608

[45] Date of Patent: Jan. 22, 1985

[54] WELL INJECTION SYSTEM

[75] Inventors: Charles R. Williams; John H. Yonker, both of Carrollton; Robert L. Thurman, McKinney, all of Tex.

[73] Assignee: Otis Engineering Corporation, Dallas, Tex.

[21] Appl. No.: 447,023

[22] Filed: Dec. 6, 1982

[51] Int. Cl.[3] ..... E21B 34/10

[52] U.S. Cl. ..... 166/317; 166/322; 137/70

[58] Field of Search ..... 166/321, 322, 317, 323, 166/320, 319, 332, 151, 152; 137/70, 71

[56] References Cited

U.S. PATENT DOCUMENTS

| | | | |
|---|---|---|---|
| 2,251,977 | 8/1941 | Burt | 166/319 |
| 3,319,717 | 5/1967 | Chenoweth | 166/115 |
| 3,455,382 | 7/1969 | Chenoweth | 166/115 |
| 4,270,610 | 6/1981 | Barrington | 166/317 |
| 4,324,293 | 4/1982 | Hushbeck | 166/317 |
| 4,352,366 | 10/1982 | Fisher, Jr. | 166/321 |

*Primary Examiner*—James A. Leppink
*Assistant Examiner*—Hoang C. Dang
*Attorney, Agent, or Firm*—Roland O. Cox

[57] ABSTRACT

A well system for injection into a selected formation in each tubing string in a multiple formation dual string well completed for through flow line/pumpdown operation, utilizing a string of tools which may be pumped down tubing to open selected tubing sleeve valves between packers. Each tool string includes a pressure openable injection valve which seals across the open sleeve valve and is opened for formation injection flow at preselected pressures by application of tubing pressure at the surface. One type of injection valve closes to flow through when pressure opened for injection flow. The other injection valve is closed to injection flow on insertion of a closing prong having a through flow passage. Both injection valves and their respective tool strings may be individually retrieved closing sleeve valves in each tubing and the formations to injection.

23 Claims, 7 Drawing Figures

WELL INJECTION SYSTEM

REFERENCE TO RELATED APPLICATIONS

The improved shifting tool of co-pending U.S. application Ser. No. 422,739, filed Sept. 24, 1982, is used as a component of apparatus of this invention. The valve of co-pending U.S. application Ser. No. 368,690, filed Apr. 15, 1982, may be used in the invention system for well producing operations.

FIELD OF THE INVENTION

This invention relates to apparatus useful in well flow control and more particularly to apparatus used in an injection system in dual tubing string wells operated by through flow line (TFL)/pumpdown methods.

DESCRIPTION OF THE PRIOR ART

Water or gas is often injected into hydrocarbon producing formations in wells after the formation pressure decreases and formation hydrocarbons will no longer flow to surface. U.S. Pat. Nos. 3,319,717 and 3,455,382, both to C. V. Chenoweth, show apparatus and systems useful for injecting fluids in multizone wells not operated by TFL/pumpdown methods. The multiple formation system shown in U.S. Pat. No. 3,319,717 is not selective because one formation cannot be opened to injection while others remain closed.

Previous systems for TFL/pumpdown wells using tool strings pumped down for injection often could not be operated because pressured pump out fluid supplied underneath the tool string to move the tool string back to surface would flow into the open formation below the tools at relatively low pressure and not increase tubing pressure sufficiently under the TFL/pumpdown tool strings to move them up the tubing to be pumped out.

SUMMARY OF THE INVENTION

The system and apparatus of this invention provide for injection into a selected formation in each tubing string in a multiple formation dual tubing string well, operable by TFL/pumpdown methods, having two tubing strings and a connecting H-member below the bottom packer, wherein the formation zones are isolated by well packers and there is a sliding sleeve valve between packers in one tubing string running through the isolating packers, selectively openable for tubing-formation flow by a TFL/pumpdown tool string carrying a pressure openable injection valve. If desired, sliding sleeve valves may be used in both tubing strings between packers.

There are two pressure openable injection valves used in this well system, both of which seal across an open sliding sleeve valve and close the open sleeve valve to tubing-formation flow. One embodiment of the injection valve closes to flow through when the valve is pressure opened for injection flow through wall ports into a formation. The other injection valve remains open to flow through when open for injection flow and is closed to flow through by insertion of a closing prong which has a through flow passage.

One formation in the dual tubing well may be opened for injection by installing and pressure opening an injection valve closed to flow through. After completing injection, the valve closed to flow may be pumped out of a pumpdown well conventionally by pumping down the other tubing string across through the H-member and up under the valve closed to flow through to move its tool string up, closing the sliding sleeve valve, which prevents flow into the annulus and formation and directs pumped fluid up tubing pumping the tool string back to surface.

To open two formations in the well for injection, an open to flow through injection valve should be installed first in the higher pressure formation tubing and a closable to flow through injection valve installed second in the low pressure formation tubing. On pressure opening, the injected flow is from tubing through injection valves and open sliding valves into annuli and formations as the low pressure formation injection valve is closed to flow through and the high pressure formation injection valve is open to flow through.

After injection operations are completed, the procedure for closing both formations and retrieving both injection valves by TFL/pumpdown methods would be to pump a tool string carrying a closing prong having a through flow passage down the first tubing and close the open to flow through injection valve to injection flow. Next, pump a tool string down the second tubing for retrieval of the low pressure formation injection valve. Now, with both formations closed to injection flow, the second low pressure formation sliding valve may be closed by pumping down the first string through the closing prong and below to cross over through the H-member and up under the second tool string, moving it up, closing the second formation sliding sleeve and releasing the tool string for retrieval of the injection valve and tool string to surface. Now, pumping down the second string through the H-member over into and up the first string and through the prong moves the tool string up to close the first formation sliding sleeve valve and moves the released tool string, prong and injection valve up the first tubing to surface.

An object of this invention is to provide a well injection system for multiple formation wells.

Another object of this invention is to provide an injection system for wells wherein injection devices may be installed or removed using TFL/pumpdown methods.

Another object of this invention is to provide a well injection system wherein a selected formation in each tubing may be opened for injection flow.

A fourth object of this invention is to provide a well injection system wherein the formations may be opened for injection flow in a predetermined sequence.

Another object of this invention is to provide injection valves which may be opened for injection flow by a predetermined pressure.

Another object of this invention is to provide an injection valve which closes to flow through when opened for injection flow by a predetermined pressure.

Also, an object of this invention is to provide an injection valve which is open to flow through when opened for injection flow by a predetermined pressure.

BRIEF DESCRIPTION OF THE DRAWING FIGURES

FIGS. 4A and 4B is a half-sectioned drawing in elevation of another embodiment of the injection valve of this invention shown open for injection flow through wall ports and closed to flow through.

DESCRIPTION OF THE PREFERRED EMBODIMENTS

Figure 1:
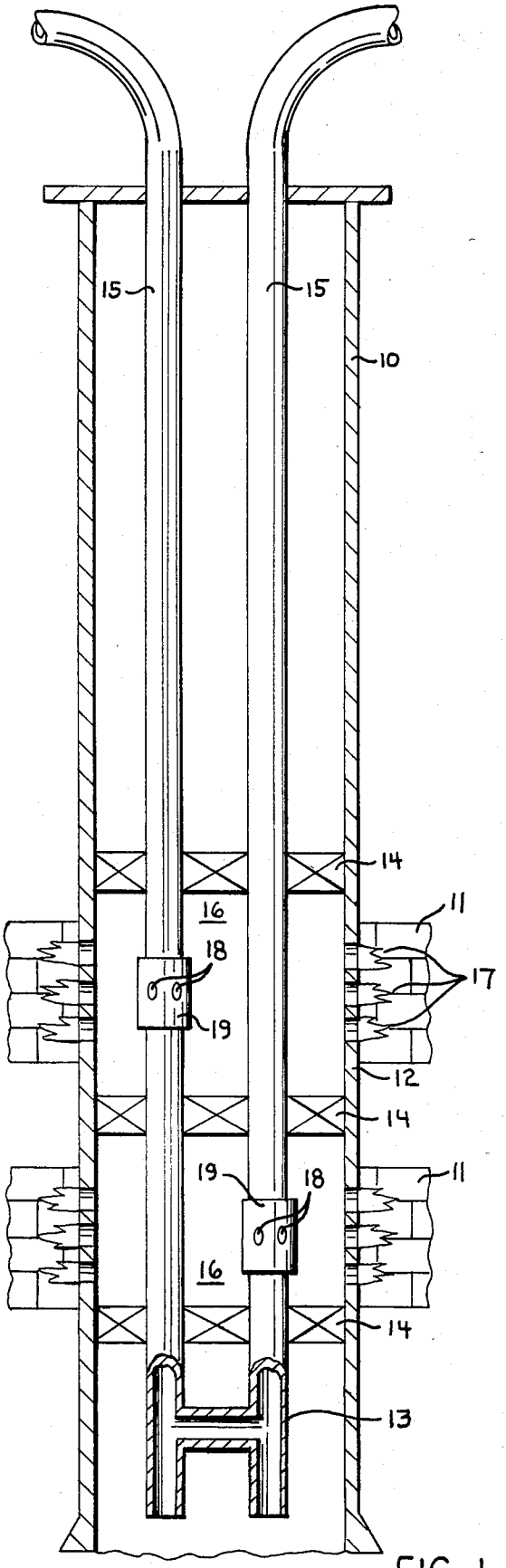
FIG. 1 is a schematic representation drawing of a well completed to utilize the system and injection valves of this invention.

Referring now to FIG. 1, there is shown an earth borehole 10 passing through earth formations 11 having a casing 12 therein, wherein there has been installed an H-member 13 and dual packers 14 with two tubing strings 15 running through each packer. The packers, when installed and set, create tubing-casing annuli 16 and define the formation zones within the casing. Flow between the earth formations and casing annuli may occur through perforations 17. Flow between the tubing and casing annuli may occur through ports 18 in sliding sleeve valves 19 in tubing, which are selectively opened and closed to flow by pumping a tool string 20 down tubing into or up tubing out of each sliding sleeve valve.

Figure 2:
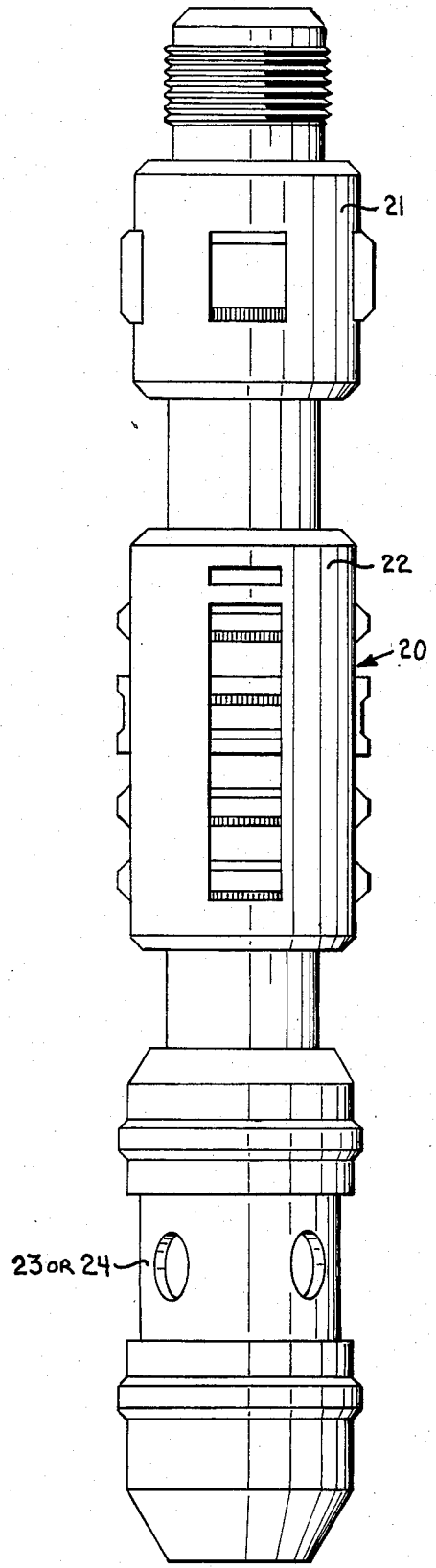
FIG. 2 is a schematic drawing of a TFL pumpdown tool string including the injection valves of this invention.

The tool string 20, shown in FIG. 2, consists of a lock mandrel section 21, a selective improved shifting tool section 22 (of a related co-pending application), each having a through flow passage, and a flow valve 23 (FIG. 3) of this invention or a flow valve 24 (FIG. 4) of this invention. When a tool string is attached to a pumpdown locomotive and running tool (not shown) and pumped down tubing into a sliding sleeve valve, the improved shifting tool selectively engages and opens the sleeve valve with the closed flow valve positioned and sealing across open sleeve valve ports 18.

Figure 3A:
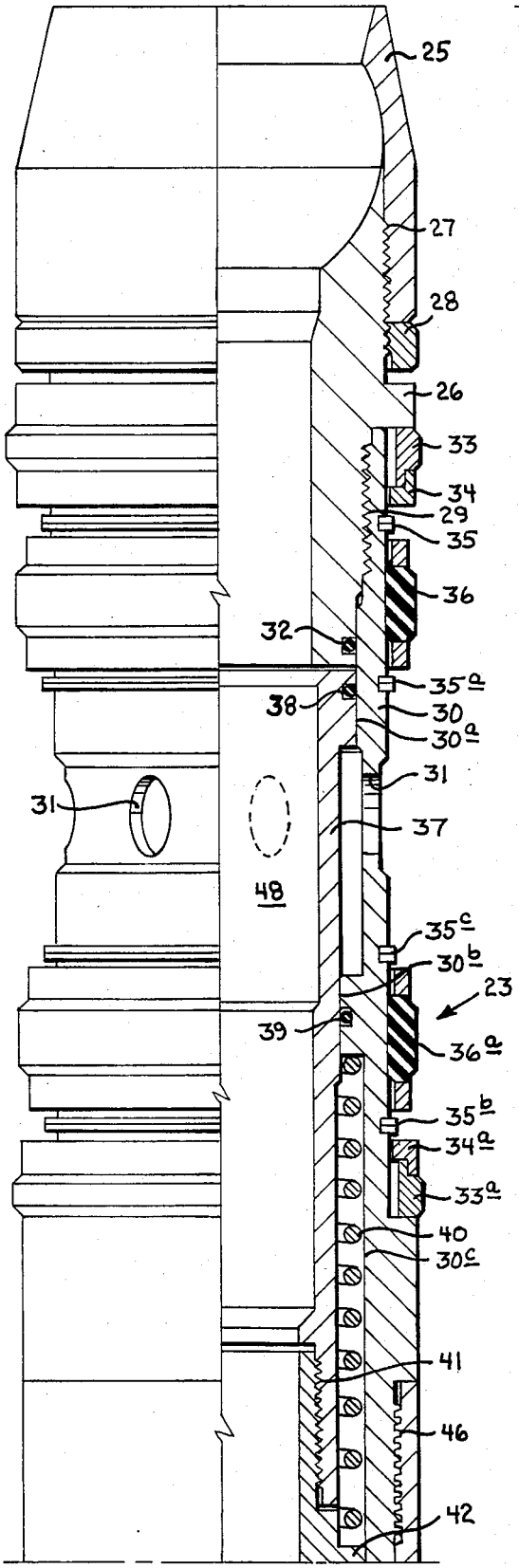
FIGS. 3A and 3B is a half-sectioned elevational drawing of an injection valve of this invention open to flow through and closed to injection flow through wall ports.
Figure 3B:
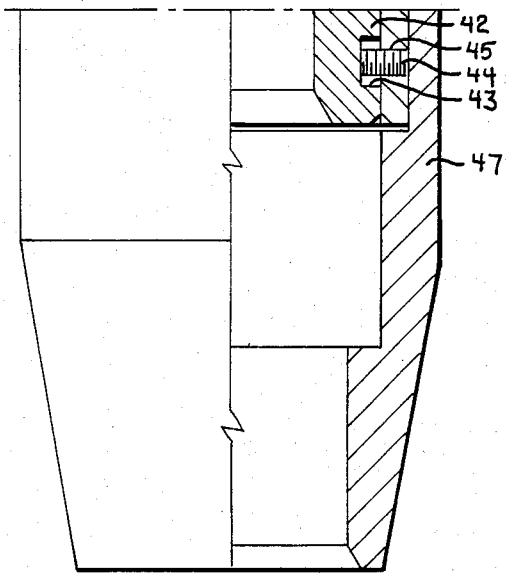

FIG. 3 shows the injection valve assembly 23 open to flow through wherein there is provided a connector cap 25 attached to an upper connector 26 by thread 27 and positioned thereon by jam nut 28, for connecting the injection valve to the lower end of an improved shifting tool. The lower end of the upper connector is threadedly connected at 29 to the upper end of body 30 with ports 31 and sealed thereto with resilient seal 32. Mounted on the upper outside of the ported body is a wear ring 33 positioned between an outer body shoulder and ring 34 and retained there by retaining ring 35 housed in a groove on the body. A molded resilient seal ring 36 is positioned on and seals to the body and is retained there by another retaining ring 35*a* housed in a lower groove on the body. Slidably disposed in body seal bores 30*a* and 30*b* is a piston valve 37, sealed to bores 30*a* and 30*b* with resilient seals 38 and 39, respectively, to form an annular differential area on the upper end of the piston valve. Positioned below ports 31 on the body is a second seal ring 36*a*, which also seals on the body, a second ring 34*a* and a second wear ring 33*a*. The second wear ring is positioned between a lower shoulder on the body and ring 34*a* and both rings are retained there by a third retaining ring 35*b* housed in a groove on the lower body. Second seal ring 36*a* is retained between third and fourth retaining rings 35*c* by the fourth retaining ring housed in a body groove below the ports. A spring 40 is disposed around a lower portion of the piston valve and in a bore 30*c* bored from the lower end of the body. Attached to the lower end of the piston valve with threads 41 is a spring retainer 42 having a groove 43. A shear screw 44, installed in threads 45 near the lower end of the body, protruding into groove 43, releasably positions the spring retainer and attached piston valve in up position, closing the body ports to flow while the compressed spring is biasing the retainer and valve down toward the valve open position. Connected to the lower end of the body 30 by threads 46 is a housing 47. There is a longitudinal flow passage 48 through the injection valve 23.

Figure 4A:
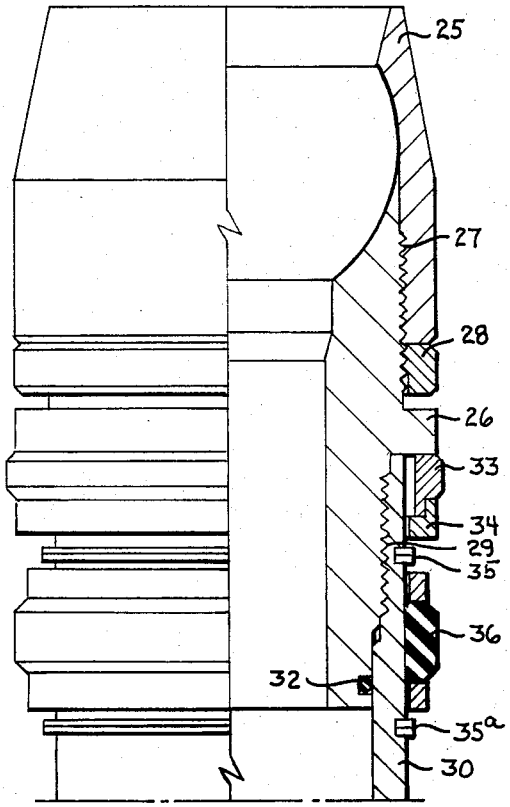
Figure 4B:
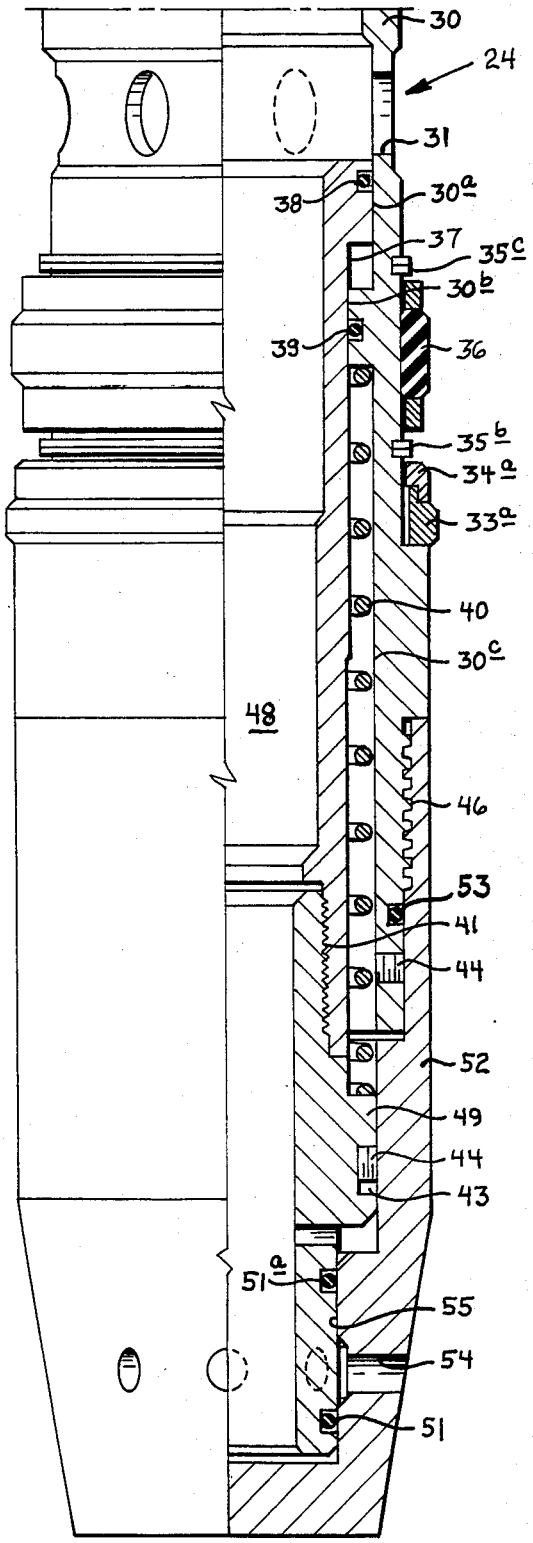

Referring now to FIG. 4, there is shown another embodiment of the injection valve of this invention open to port flow and closed to flow through. The injection valve assembly 24 of FIG. 4 is identical to the flow valve 23 except connected to the lower end of the piston valve 37 by threads 41 is a lower valve 49 having a groove 43 and spaced apart resilient seals 51 and 51*a* mounted in grooves thereon. Connected to the lower end of the body 30 in flow valve 24 with threads 46 is a lower valve housing 52, sealed to the body with a resilient seal 53. The lower housing is provided with flow ports 54 and an internal seal bore 55 wherein seals 51*a* and 51 may seal above and below ports 54 to close off flow through ports 54 into flow passage 48.

Figure 5:
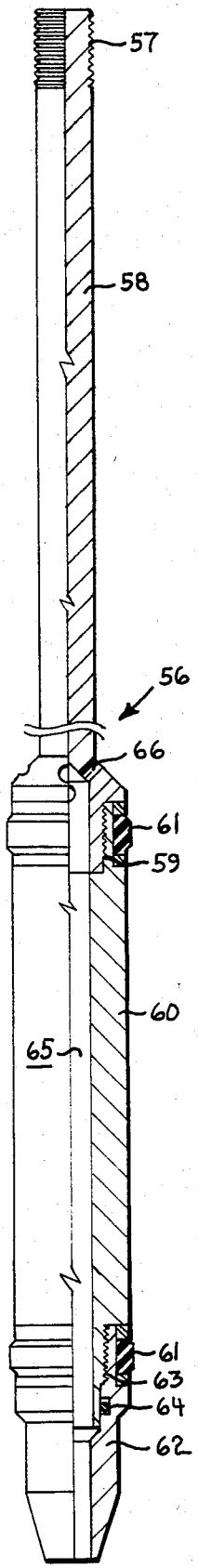
FIG. 5 is a half-sectioned drawing in elevation of a closing prong useful in operating the invention system.

FIG. 5 shows a closing prong assembly 56 for valve 23 having a flow passage through. On the upper end of the prong is a thread 57 on rod 58 for attaching the prong assembly to the lower end of a pulling tool (not shown). Attached to the lower end of the rod by thread 59 is a mandrel 60 on which is mounted an upper resilient seal 61 between a lower shoulder on the rod and an upper shoulder on the mandrel. A lower mandrel 62 which carries a lower resilient seal 61 between a lower shoulder on the mandrel and a shoulder on the lower mandrel is connected to the upper mandrel by thread 63 and sealed thereto by resilient seal 64. A longitudinal flow passage 65 is provided in the lower portion of the prong which connects with ports 66 to exit above upper seal 61.

BEST MODE FOR CARRYING OUT THE INVENTION

Install a shear pin 44 which will shear at the desired tubing pressure in first injection valve 23, which is the lower section of tool string 20. Attach the tool string to a running tool with pumpdown locomotives and pump the tool string down the tubing 15 having the highest pressure formation sliding sleeve valve 19 in a well completed for TFL/pumpdown operation as shown in FIG. 1. The shear pin positions the spring retainer 42 and connected piston valve 37 up, and resilient seal 38 seals in seal bore 30*a* while seal 39 seals on the piston valve closing ports 31 to flow. As this first tool string enters the higher pressure sliding sleeve valve, the improved shifting tool 22 positions seals 36 and 36*a*, FIG. 3, across sleeve valve ports 18 with closed flow valve ports 31 opposite and opens the sliding sleeve valve for flow through ports 18, annulus 16, perforations 17 to formation 11. The lock mandrel 21 in the tool string locks the injection valve in position in the sliding sleeve valve and also locks the sliding valve open. The released running tool and tool string are now pumped back to the surface.

Next, a shear pin 44 for the second injection valve 24, FIG. 4, should be selected, which will shear at a lower pressure than pin 44 selected for flow valve 23 and installed in flow valve 24. The shear pin positions the piston valve 37 and connected lower valve 49 up closing ports 31 to flow while lower ports 54 are open to flow. A tool string 20, with the closable to flow through flow valve 24 lower section, is pumped down the second tubing. As the tool string 20 enters the lower pressure formation sliding sleeve valve, the improved selective shifting tool 22 engages the sliding valve, positions closed to flow ports 31 opposite sliding valve ports 18 and opens ports 18 to flow. Lock 21 in tool string 20 locks the tool string in the sliding sleeve valve and also locks the sliding valve open. The released running tool and tool string are now pumped back to the surface.

Now, both injection valves installed in tubing may be opened as required for injection flow by applying appropriate pressure at the surface to tubing. Pressure to open the injection valve 24, FIG. 4, in the second tubing sliding sleeve valve for injection flow and close the valve to flow through can be applied down both tubing strings onto the differential sealed area between body bores 30*a* and 30*b* on the upper end of piston valve 37, shearing pin 44, forcing piston valve 37 and lower valve 49 down, moving resilient seal 38 from seal bore 30*a*, opening ports 31 to flow while moving lower resilient seal 51 below ports 54 in seal bore 55 and upper resilient seal 51*a* into seal bore 55 above ports 54, thus closing ports 54 to flow from flow passage 48.

Injection flow may now occur between second tubing and formation through lock 21, shifting tool 22, closed to flow through flow passage 48 and ports 31 in injection valve 24, ports 18 in low pressure formation sliding valve 19, annulus 16, and perforations 17 and into the lower pressure formation 11.

If desired, the high pressure formation may also be opened for separate injection flow by pressuring the first tubing at surface to a pressure usually about 500 psi greater than the lower pressure formation to act on the differential area on the upper end of piston valve 37 and shear the stronger pin 44 in the injection valve 23 not closable to flow through as shown in FIG. 3. Injection flow may now occur between the high pressure formation and the first tubing string through lock 21, shifting tool 22, open to flow through flow passage 48 and ports 31 in injection valve 23, ports 18 in valve 19, annulus 16 and perforations 17. The higher injection pressures are also transmitted down the tubing, across the H-member and up under the closed to flow through injection valve 24.

After completing well injection operations, the two tool strings with their injection valves may be retrieved and sliding sleeve valves open to each formation closed by pumping a pulling tool string with a closing prong 56 of FIG. 5 attached down the first tubing string in which the open to flow through valve 23 was installed in the higher pressure formation sliding sleeve valve. The closing prong enters and is positioned in the valve 23 when the pulling tool engages the lock 21 of tool string 20 so that upper prong seal 61 seals in the bore of upper connector 26 of valve 23 and lower prong seal 61 seals in the lower bore of piston valve 37 closing ports 31 and the higher pressure formation to injection flow.

A pulling tool may now be pumped down the second tubing string to engage the lock on the tool string with injection valve 24 closed to flow through in the low pressure formation open sleeve valve.

Now, pump past the tool string in the higher pressure formation sliding sleeve valve, through prong ports 66, flow passage 65, down and across H-member 13, up the second tubing string to pump the injection valve 24 and tool string up and out of the lower pressure formation sliding sleeve valve 19, closing the sliding valve ports 18 and the lower pressure formation to flow. Continued pumping will carry the tool string and valve 24 back to surface as the lower pressure formation sliding sleeve valve is closed and pumped fluid cannot enter the formation.

Fluid may now be pumped down the second tubing string through the closed low pressure sliding sleeve valve, through the H-member, up the first tubing string with the open higher pressure sliding sleeve valve with open injection valve 23 that has been closed to formation flow by closing prong 56. Fluid pumped up the tubing through prong flow passage 65 and ports 66 cannot enter the higher pressure formation and lifts the tool string from the higher pressure sliding sleeve valve 19 closing ports 18 to flow. Continued pumping carries the first tool string back to surface.

Both formations are now closed to flow and the well is in condition to selectively reestablish tubing to formation flow for future injection operations as required.

The preceding specification describes the invention system in a two formation well operated by TFL/pumpdown methods. The system may be expanded for multiple formation wells and may be operated by using wireline tools and methods as well.

The valve of the earlier noted co-pending application may be substituted for injection valves 23 and 24 in the TFL/pumpdown tool strings to operate the well system of this invention as a producing well wherein production flow is from formation to tubing and the valve of the co-pending application acts as a tubing standing valve preventing back flow and injection into formations.

We claim:

1. A valve connectable in a string of well tools, comprising:

a. a tubular body with a bore therethrough;

b. flow passage means in said body communicating said body bore with the exterior of said body; and c. sliding sleeve valve means in said body controlling flow through said flow passage means including a downwardly biased piston valve member slidably mounted in and sealingly engaging said body above and below said flow passage means and releasably positioned in up flow passage means closed to flow position by a frangible pin through the body wall below said flow passage means and protruding into a recess in said piston valve, said piston valve having an annular differential area between the larger sealed area above said flow passage means and the smaller sealed area below said flow passage means responsive to pressure in said body bore for releasing said piston valve on application of a predetermined pressure in said body bore to slide to a down position opening said flow passage means to flow.

2. The valve of claim 1 wherein the flow passage means in the body comprise at least one port through the body wall.

3. The valve of claim 2 wherein the piston downward bias is a coil spring disposed around the piston between an internal shoulder in the body below the smaller sealed area and a lower external shoulder on the piston.

4. The valve of claim 3 including external seals mounted on the body above and below the body port.

5. The valve of claim 4 further including a pair of wear rings mounted on the body, one above and one below the external seals.

6. The valve of claim 4 in combination with an improved shifting tool in a well tool string.

7. The valve of claim 4 in combination with an improved shifting tool and lock mandrel in a well tool string.

8. The tool string of claim 7 in combination with a sliding sleeve valve in a well tubing string.

9. The tool string combination of claim 8 further including a closing prong positioned in the valve closing the body port to flow.

10. The tool string of claim 7 further including a closing prong positioned in the valve closing the body port to flow.

11. The valve of claim 4 wherein a closing prong has been positioned closing the body port to flow.

12. A valve connectable in a well tool string, comprising:

a. a tubular body with a bore therein closed at the lower end;

b. upper and lower flow passage means in said body communicating said body bore with the exterior of said body;

c. sliding valve means in said body controlling flow through said upper and lower flow passage means;

d. releasable positioning means positioning said sliding valve means up closing said upper flow passage means to flow and opening said lower flow passage means to flow; and e. means on said sliding valve means biasing said sliding valve means downwardly toward a position opening said upper flow passage means to flow and closing said lower flow passage means to flow.

13. The valve of claim 12 wherein said sliding valve means consists of a piston slidably mounted in said body to sealingly engage said body below said upper flow passage means and above and below said lower flow passage means when in down upper flow passage means open to flow and lower flow passage means closed to flow position and sealingly engaging said body above and below said upper flow passage means and above said lower flow passage means when in up upper flow passage means closed to flow and lower flow passage means open to flow position, said piston having means responsive to a predetermined pressure in said body bore releasing said positioning means.

14. The valve of claim 13 wherein said piston responsive means consist of the differential area between the larger sealed area above said flow passage means and the smaller sealed area below said flow passage means on the piston when said piston is in up upper flow passage means closed to flow position.

15. The valve of claim 14 wherein the releasable positioning means comprise a frangible pin through the body wall below the piston-body seal below said upper flow passage means protruding into a slot in said piston above said upper piston-body seal which sealingly engages said piston above said lower flow passage means.

16. The valve of claim 15 wherein the upper and lower flow passage means in the body each comprise at least one port through the body wall.

17. The valve of claim 16 wherein the sliding valve biasing means includes a coil spring disposed around the piston between an internal shoulder in the body below the lower piston-body seal and lower external shoulder on the piston.

18. The valve of claim 17 including external seals mounted on the body above and below the upper body port.

19. The valve of claim 18 further including a pair of wear rings mounted on the body, one above and one below the external seals.

20. The valve of claim 18 in combination with an improved shifting tool in a well tool string.

21. The valve of claim 18 in combination with an improved shifting tool and lock mandrel in a well tool string.

22. The tool string of claim 21 in combination with a sliding sleeve valve in a well tubing string.

23. A valve connectable in a string of well tools, comprising:

a. a tubular body with a bore therethrough;

b. flow passage means in said body communicating said body bore with the exterior of said body; and c. sliding sleeve valve means in said body controlling flow through said flow passage means including a downwardly biased piston valve member slidably mounted in and sealingly engaging said body above and below said flow passage means and means releasably positioning said piston valve in up flow passage means closed to flow position, said piston valve having an upper end differential area responsive to pressure in said body bore for releasing said piston valve on application of a predetermined pressure in said body bore to slide to a down position opening said flow passage means to flow.

* * * * *